US007982687B1

(12) United States Patent
Santoru

(10) Patent No.: US 7,982,687 B1
(45) Date of Patent: Jul. 19, 2011

(54) KA/KU OUTDOOR UNIT CONFIGURATION USING A FREQUENCY SELECTIVE SURFACE

(75) Inventor: Joseph Santoru, Agoura Hills, CA (US)

(73) Assignee: The DIRECTV Group, Inc., El Segundo, CA (US)

( * ) Notice: Subject to any disclaimer, the term of this patent is extended or adjusted under 35 U.S.C. 154(b) by 362 days.

(21) Appl. No.: 12/244,684

(22) Filed: Oct. 2, 2008

(51) Int. Cl.
*H01Q 15/02* (2006.01)

(52) U.S. Cl. ..... 343/909; 343/776; 343/779; 343/781 R

(58) Field of Classification Search ..... 343/781 R, 343/781 P, 781 CA, 837, 840, 909, 753, 836, 343/776, 779
See application file for complete search history.

(56) References Cited

U.S. PATENT DOCUMENTS

| | | | | |
|---|---|---|---|---|
| 5,471,224 | A * | 11/1995 | Barkeshli | 343/909 |
| 5,812,096 | A | 9/1998 | Tilford | |
| 6,181,293 | B1 | 1/2001 | Muhlhauser et al. | |
| 6,512,485 | B2 * | 1/2003 | Luly et al. | 343/781 CA |
| 6,600,730 | B1 | 7/2003 | Davis et al. | |
| 7,068,616 | B2 | 6/2006 | Chang et al. | |

OTHER PUBLICATIONS

Parker, E.A.; "The Gentlemen's Guide to Frequency Selective Surfaces"; 17th QMW Antenna Symposium; London, United Kingdom; Apr. 1991; pp. 1-18.

Hooberman, Benjamin; "Everything You Ever Wanted to Know About Frequency-Selective Surface Filters But Were Afraid to Ask"; May 2005; pp. 1-22.

Notice of Allowance dated Aug. 11, 2008 in U.S. Appl. No. 11/712,327 filed Feb. 28, 2007 by Kesse Ho et al.

Final Rejection dated Jul. 14, 2008 in U.S. Appl. No. 11/712,327 filed Feb. 28, 2007 by Kesse Ho et al.

Non-final Office Action dated Jan. 24, 2008 in U.S. Appl. No. 11/712,327 filed Feb. 28, 2007 by Kesse Ho et al.

Notice of Allowance dated Dec. 1, 2006 in U.S. Appl. No. 11/015,705 filed Dec. 17, 2004 by Kesse Ho et al., now issued as US Patent No. 7,202,833.

Non-final Office Action dated Aug. 18, 2006 in U.S. Appl. No. 11/015,705 filed Dec. 17, 2004 by Kesse Ho et al., now issued as US Patent No. 7,202,833.

* cited by examiner

*Primary Examiner* — Hoang V Nguyen

(57) ABSTRACT

Methods, systems, and apparatuses for receiving signals from communications satellites are disclosed. An antenna unit for receiving signals transmitted from a plurality of communications satellites at a plurality of orbital slots, in accordance with one or more embodiments of the present invention comprises a first reflecting surface, a frequency selective reflective surface, and a plurality of low noise block down converters with feedhorns (LNBFs), wherein at least a first LNBF is placed on the antenna unit in a first location and receives at least first signals at a first frequency band from a first orbital slot and at least a second LNBF is placed on the antenna unit at a second location and receives at least second signals at a second frequency band from the same orbital slot, wherein the first signals reflect from the first reflecting surface and transmit through the frequency selective surface and the second signals reflect from the first reflecting surface and also reflect from the frequency selective surface.

10 Claims, 6 Drawing Sheets

Center feed is for the 101 orbital slot. The solid line indicates that this feed can have a smaller aperture since the lowest operating frequency is only 18.2 GHz as compared with 17.3 GHz for the two outside feeds. Or it can simply be the same design as the two outside feeds.

KA/KU OUTDOOR UNIT CONFIGURATION USING A FREQUENCY SELECTIVE SURFACE

BACKGROUND OF THE INVENTION

1. Field of the Invention

The present invention relates generally to direct broadcast satellite systems, and in particular, to a Ka-band and Ku-band outdoor unit using a frequency selective surface on a single-offset dish antenna.

2. Description of the Related Art

Satellite broadcasting of communications signals has become commonplace. Satellite distribution of commercial signals for use in television programming currently utilizes multiple feedhorns on a single Outdoor Unit (ODU) which supply signals to multiple Integrated Receiver-Decoders (IRDs) on separate cables from an integrated multiswitch. Additional IRDs can be serviced with external cascaded multiswitches.

In a satellite broadcasting system, a service provider may broadcast video programming signals from transponders on multiple satellites in multiple different orbital slots. These orbital slots are typically located at 101 West Longitude (WL), 119 WL, and 110 WL, also known as Sat A, Sat B, and Sat C, respectively, but can be at other locations as available. The FCC (Federal Communications Commission) allocates transponders on the various satellites at the orbital slots for use in broadcasting television signals.

These satellites typically broadcast in the Ku-band of frequencies, typically between 12.2 GHz and 12.7 GHz. Additional satellites are also deployed at other orbital slots, and are compatible with the already-deployed satellites used within the system. These newly-deployed satellites typically broadcast in the Ka-band of frequencies, typically between 18 and 20 GHz. The additional satellites can be placed on-orbit at any location, but currently, the locations are at 99 WL and 103 WL. Additional satellites may be placed at other locations, such as 101 WL.

Although additional ODUs can be installed to receive the Ka-band frequencies, installation of an additional ODU at a given location may be difficult, as well as costly. Further, multiple ODU installations will be difficult to connect to existing systems, because of potential additional cable runs as well as possible interference with existing equipment.

It can be seen that there is a need in the art for an ODU that can receive both Ka-band and Ku-band signals. There is also a need for a method that takes into account the position of the satellites that are transmitting these frequencies, as well as designing the ODU to maximize the signal strength from the Ka-band.

SUMMARY OF THE INVENTION

The present invention discloses methods, systems, and apparatuses for receiving signals from communications satellites.

An antenna unit for receiving signals transmitted from a plurality of communications satellites at a plurality of orbital slots, in accordance with one or more embodiments of the present invention comprises a first reflecting surface, a frequency selective reflective surface, and a plurality of low noise block down converters with feedhorns (LNBFs), wherein at least a first LNBF is placed on the antenna unit in a first location and receives at least first signals at a first frequency band from a first orbital slot and at least a second LNBF is placed on the antenna unit at a second location and receives at least second signals at a second frequency band from a second orbital slot, wherein the first signals reflect from the first reflecting surface and transmit through the frequency selective surface and the second signals reflect from the first reflecting surface and also reflect from the frequency selective surface.

Such an antenna unit further may optionally comprise the first frequency band being Ka-band, the second frequency band being Ku-band, and the first signals and the second signals are transmitted from the same orbital slot.

A method in accordance with one or more embodiments of the present invention comprises reflecting a first signal in a first frequency band from a surface, reflecting a second signal in a second frequency band from the surface simultaneously with the first signal, and reflecting the second signal in the second frequency band from a frequency selective surface while the first signal in the first frequency band transmits through the frequency selective surface.

Such a method further may optionally comprise the first frequency band being Ka-band, the second frequency band being Ku-band, and the first signal and the second signal being transmitted from the same orbital slot.

A satellite television signal reception system in accordance with one or more embodiments of the present invention comprises a reflecting dish, a frequency selective surface, a first low noise block down converter with feedhorn (LNBF) receiving first signals that are reflected from the reflecting dish and transmitted through the frequency selective surface, and a second LNBF receiving second signals that are reflected from the reflecting dish and reflected from the frequency selective surface.

Such a system may further optionally comprise the first signals being in a Ka-band and the second signals being in a Ku-band.

BRIEF DESCRIPTION OF THE DRAWINGS

Referring now to the drawings in which like reference numbers represent corresponding parts throughout.

DETAILED DESCRIPTION

In the following description, reference is made to the accompanying drawings which form a part hereof, and which show, by way of illustration, several embodiments of the present invention. It is understood that other embodiments may be utilized and structural changes may be made without departing from the scope of the present invention.

Satellite Distribution of Signals

Figure 1:
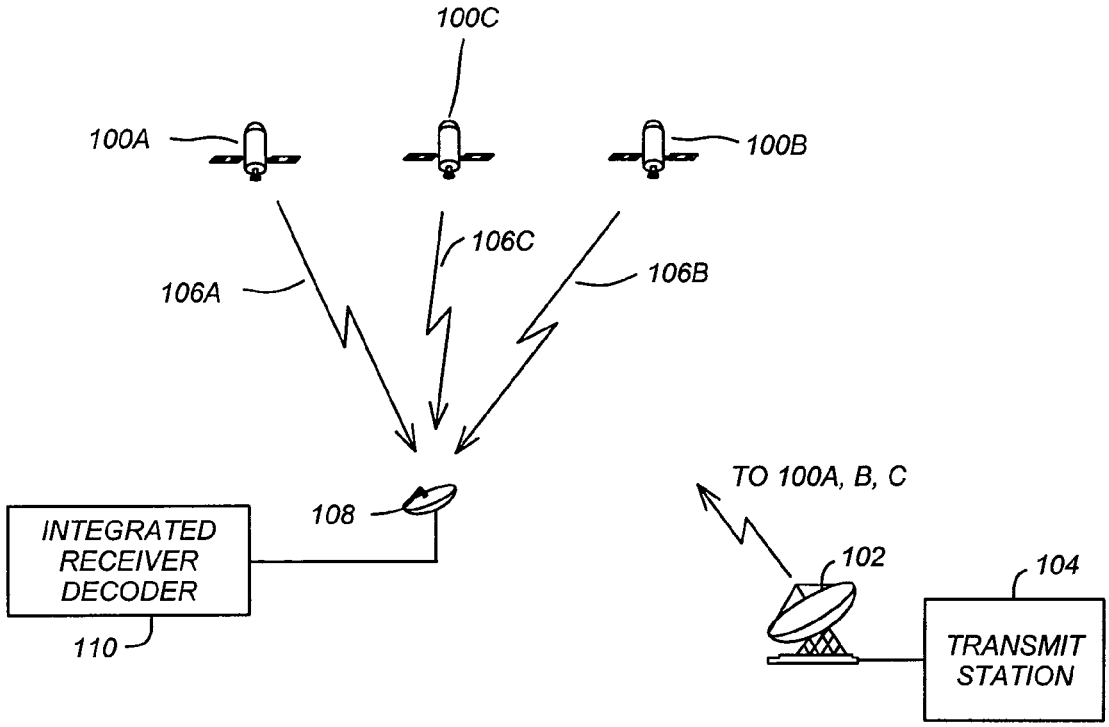
FIG. 1 is a diagram illustrating an overview of a multiple satellite video distribution system according to the preferred embodiment of the present invention.

FIG. 1 is a diagram illustrating an overview of a multiple satellite video distribution system according to the preferred embodiment of the present invention. The system includes multiple satellites 100A-C, uplink antenna 102, and transmit station 104. In the preferred embodiment, the three satellites 100A-C are in three different orbital slots located at 101 West Longitude (WL) 100A, 119 WL 100B, and 110 WL 100C, wherein the video programming signals 106A-C are transmitted from transponders 1-32 on 101 WL 100A, transponders 22-32 on 119 WL 100B, and transponders 28, 30, and 32 on 110 WL 100C. Additional satellites 100A-C can be located at additional orbital slots, or additional satellites can be present at the listed orbital slots, without departing from the scope of the present invention.

The radio frequency (RF) signals 106A-C are received at one or more downlink antennae 108, which in the preferred embodiment comprise subscriber receiving station antennae 108, also known as outdoor units (ODUs). Each downlink antenna 108 is coupled to one or more integrated receiver-decoders (IRDs) 110 for the reception and decoding of video programming signals 106A-C.

Receive Antenna

Figure 2:
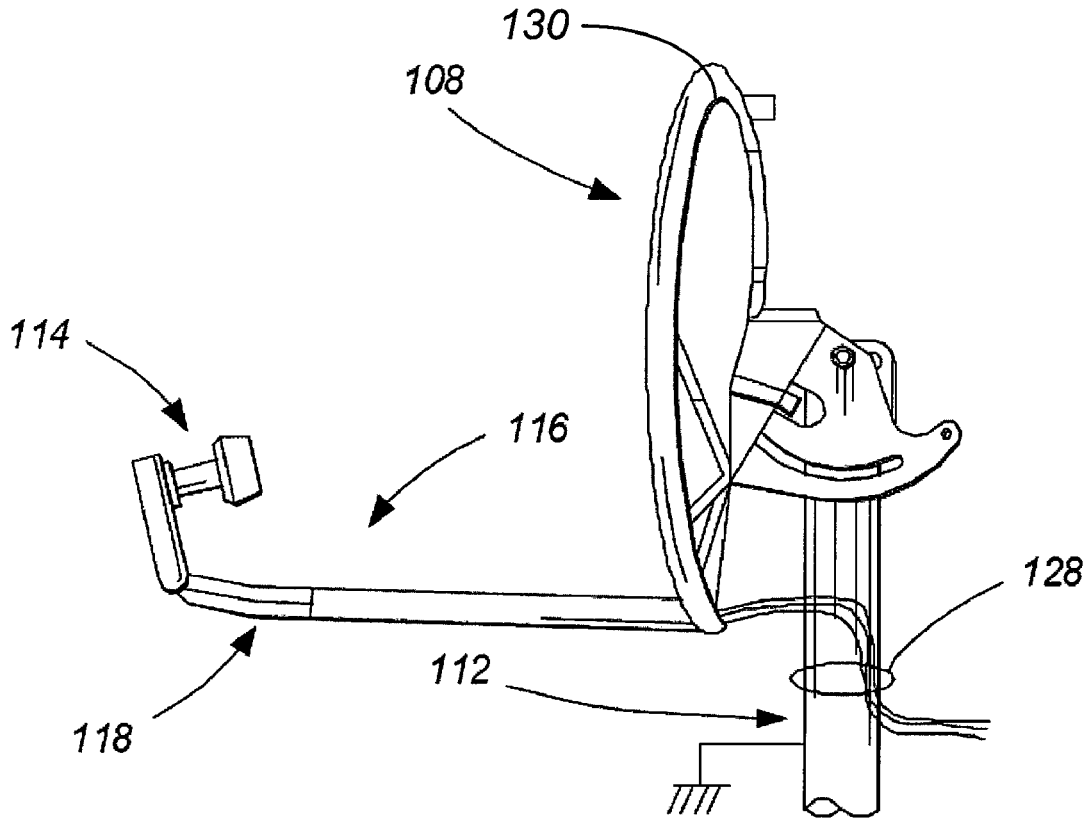
FIG. 2 PRIOR ART
FIGS. 2 & 3 illustrate an antenna configured according to the related art.
Figure 3:
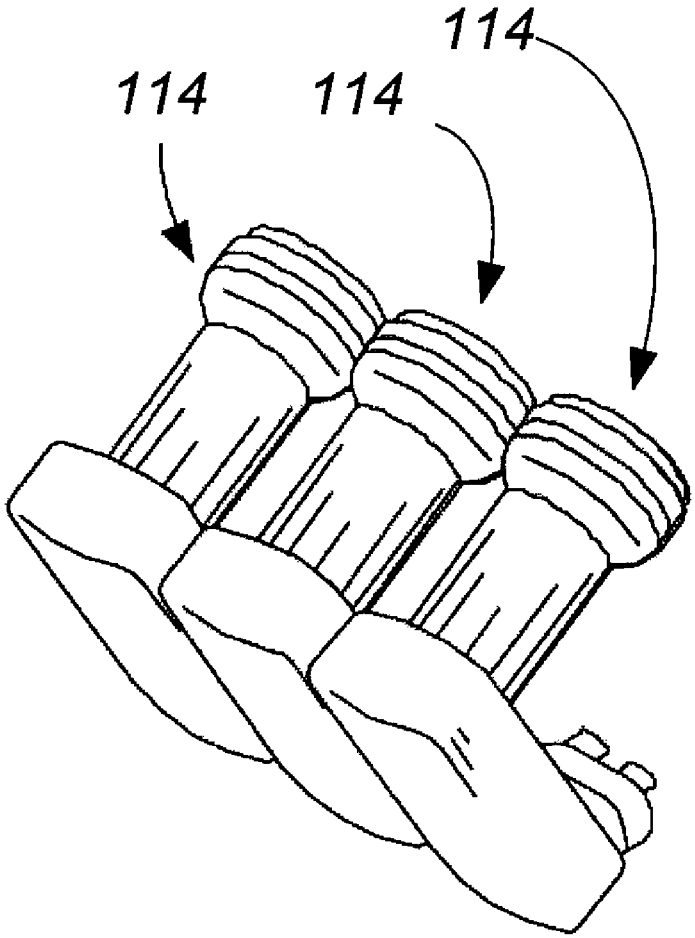
FIG. 3 PRIOR ART

FIG. 2 illustrates the subscriber antenna 108 as configured according to the related art. Other sizes and configurations of related art antennas 108 are currently in use, however, the operation and approximate configuration of the related art antennas 108 are approximately represented by the antenna 108 shown in FIG. 2. In the side view of FIG. 2, the antenna 108 typically has an 18"×24" oval-shaped Ku-band reflecting surface that is supported by a mast 112, wherein a minor axis (top to bottom) of the reflecting surface is narrower than its major axis (left to right). Other sizes of reflectors 130 are possible in the antennas 108 of the related art. The antenna 108 curvature is due to the offset of one or more low noise block down converters with feed (LNBFs) 114, which are used to receive signals reflected from the antenna 108. FIG. 3 illustrates a perspective view of the LNBFs 114 of FIG. 2, located at the end of support bracket 116. Although three LNBFs 114 are shown in FIG. 2A, a greater or lesser number of LNBFs 114 can be utilized for a given antenna 108 without departing from the scope of the present invention. The number of LNBFs 114 shown is merely for illustrative purposes and in no way limits the scope of the present invention.

In the related art embodiment, a support bracket 116 positions an LNBF/Multi-SW Adapter 118 and multiple LNBFs 114 below the front and center of the antenna 108, so that the LNBFs 114 do not block the incoming signals 106A-C. Moreover, the support bracket 116 sets the focal distance between the antenna 108 and the LNBFs 114.

The LNBFs 114 comprise a first stage of electronic amplification for the subscriber receiving station. Each LNBF 114 down converts the signals 106A-C received from the satellites to a lower frequency that is recognized and used by a tuner/demodulator of the IRD 110. Typically, the signals 106A-C are in the 12.2-12.7 GHz range, and are downconverted to 950-1450 MHz signals carried by cables 128 and used by the tuner/demodulator of the IRD 110. The shape and curvature of the antenna 108 allows the antenna 108 to simultaneously direct energy into two or three proximately disposed LNBFs 114. Each LNBF 114 is typically optimized at a focal point based on the satellite location a given LNBF 114 is designed to be responsive to.

However, once additional satellites of a different frequency range, typically in the Ka-band frequency range, are transmitting signals, the antenna 108 dish 130 must change in size and/or shape to reflect enough incident radiated power to the LNBF 114 such that the signals in the different frequency range can be detected and processed by the LNBF 114 and IRD 110.

Typically, the orbital locations of the satellites 100A-C are chosen so that the signals 106A-C received from each satellite 100A-C can be distinguished by the antenna 108, but close enough so that signals 106A-C can be received without physically slewing or otherwise altering the axis of the antenna 108 by moving antenna 108 to receive signals from the various satellites 100A-C. When the user selects program material broadcast by the satellites 100A-C, the IRD 110 electrically switches LNBFs 114 to receive the broadcast signals 106A-C from the satellites 100A-C. This electrical switching occurs using a combiner and multi-switch within the LNBF/Multi-SW Adapter 118.

The Ka-band satellites currently deployed are typically located at a two degree (2°) spacing from the Ka-band satellites, e.g., when a Ku-band satellite is nominally located at 101 WL, the Ka-band satellites are nominally located at 99 WL and 103 WL. However, other satellites that transmit in different frequency bands, or in the same frequency band, can be located at other orbital slots without departing from the scope of the present invention.

The 2° spacing of the satellites allows a single antenna reflector dish of proper size and design, to intercept enough incident radiated power from the satellites to provide the LNBFs with enough signal strength for amplification without degradation of signal content.

DIRECTV downlinks or has licenses for the 18.3-18.8 and 19.7 to 20.2 GHz bands. These are routinely referred to as B-band and A-band, respectively. However, DIRECTV also has licenses for A- and B-band downlinks at the 101 orbital slot. DIRECTV has also applied for downlink licenses in the 17.3-17.7 GHz range, called Reverse Band, for the 99 and 103 orbital slots.

Receive Antenna with Folded Beampath and FSS

Figure 4:
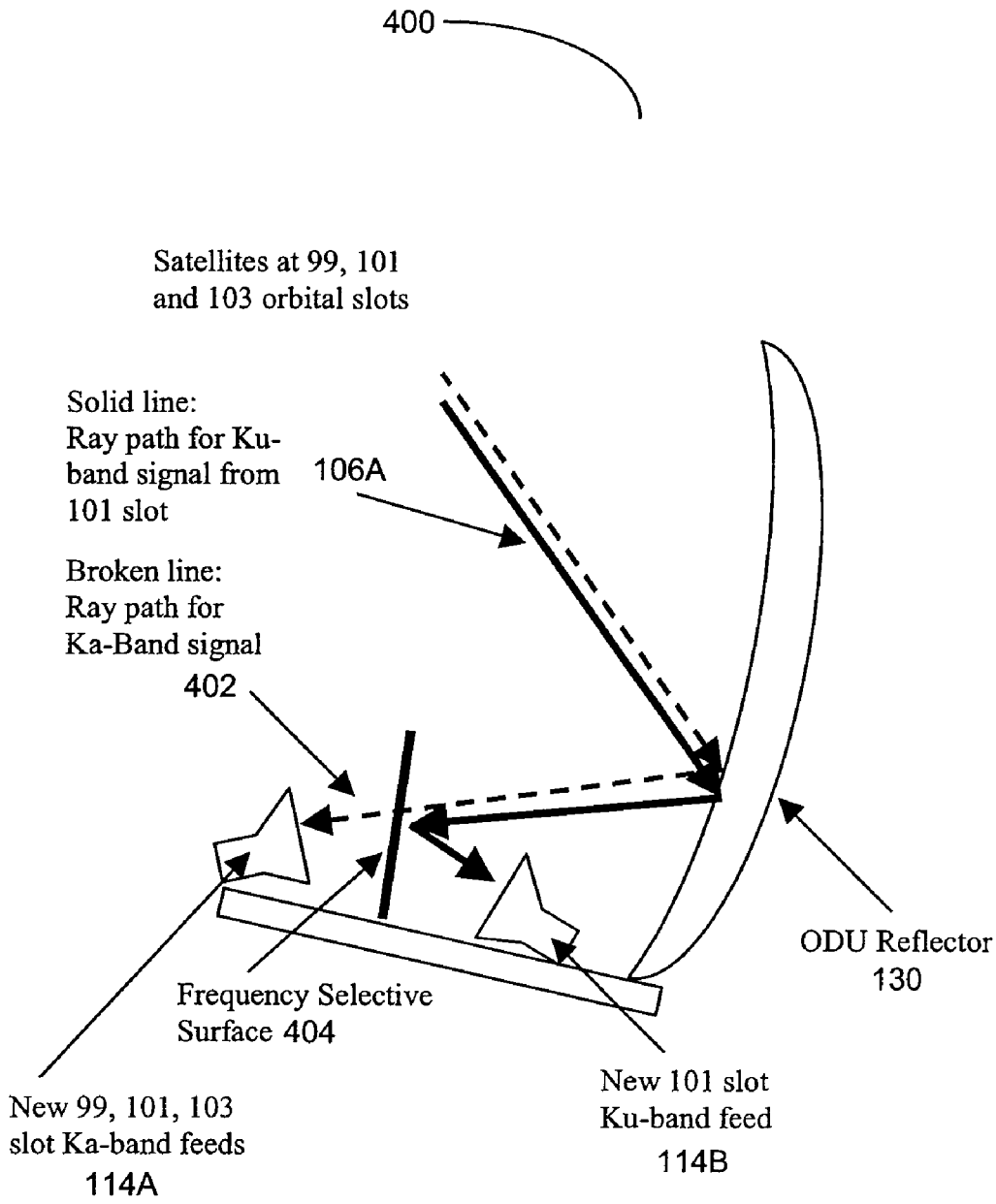
FIG. 4 illustrates a side view of one or more embodiments of the antenna of the present invention.

FIG. 4 illustrates a side view of one or more embodiments of the antenna of the present invention.

Frequency Selective Surface (FSS) ODU 400 is shown, with reflector 130 reflecting both a Ku-band downlink signal, e.g., 106A, and a Ka-band downlink signal 402. A FSS 404 is placed in the path between reflector 130 and two locations for feedhorns 114, now referred to as 114A and 114B for differentiation. Feedhorns 114A reside on the end of arm 118, while feedhorns 114B reside farther up the arm 118 closer to reflector 130. Feedhorns 114A receive downlink signals 402 at Ka-band, which passes through or around FSS 404, while feedhorns 114B receive downlink signals 106A (as well as downlink signals 106B-C if desired) at Ku-band, which reflect from FSS 404.

FSS 404 can be made in several different ways. For example, and not by way of limitation, FSS 404 can be made with a material that is close to electrically transparent at the desired frequency range, say a thin plastic sheet, and then a specially designed metallic pattern can be coated on the plastic sheet to reflect the frequency range that is desired to be reflected. Another plastic layer can then be used to protect the deposited metallic surface, and then the whole sandwiched assembly can be encased in a protective shield. The RF properties of the shield material is important. Generally, the metallic pattern is chosen so that it transmits one range of frequencies while reflecting other frequency ranges. In the FSS 404 of the present invention, typically, FSS 404 will reflect frequencies in the Ku-band, e.g., 12.2-12.7 GHz, but pass, without significant degradation, frequencies in the Ka-band, e.g., 17.3-20.2 GHz. Depending on the spacing of the satellites 100 in the constellation of satellites broadcasting signals to FSS ODU 400, the placement of feedhorns 114A and B, as well as the focal length and point of reflector 130, can be designed to properly direct the signals being received by FSS ODU 400 in order to maximize the signal strength of the signals 106 and 402. Further, the FSS ODU 400 of the present invention now allows for broadcast of both Ka-band signals and Ku-band signals from the same orbital slot, e.g., 101 WL. Any attenuation of the Ka-band signals 402 can be offset by increasing the size of reflector 130, if desired. Of course, other frequency bands for transmission/reflection from FSS 404 can be used without departing from the scope of the present invention.

The deficiencies in the designs of the related art, e.g., FIG. 2, is that the feedhorn 114 in the center, receiving signals from the 101 WL orbital slot, cannot be designed to receive signals over such a broad range of frequencies (12.2-20.2 GHz). Waveguides and other electronics associated with each band have certain length and width requirements and, as such, the conditions to receive the lower range of frequencies are violated at the higher ranges, and vice versa.

Co-location of two separate feedhorns 114 at the feedhorns 114A position results in mechanical crowding of the feedhorns 114A such that the feedhorns 114A in the related art scenario of FIG. 2 interfere with each other mechanically, as well as degrading the performance of ODU 108 in terms of signal strength at feedhorns 114A outputs. As such, merely replacing a feedhorn 114A with multiple feedhorns 114A to receive both Ka-band and Ku-band signals is not a workable solution in the long term.

An added ancillary benefit is that FSS ODU 400 provides improved reception efficiency for all the feedhorns 114A and B as compared to the arrangement in FIG. 2. This occurs because the large 12.2-12.7 GHz Ku-band feedhorn 114A, when located between the two 17.3-20.2 GHz Ka-band feedhorns 114A, is now replaced with a smaller 18.3-20.2 GHz feedhorn 114A. Since the 18.3-20.2 GHz feed is smaller than the 12.2-12.7 GHz feed, the present invention relaxes the geometry constraints imposed by the 12.2-12.7 GHz feedhorn 114A, which is moved to a new position as feedhorn 114B. Further, the feed illumination pattern on the reflector can be adjusted using the FSS ODU 400 configuration. So, for example, the location of feedhorns 114A can be optimized, and FSS 404 can be placed such that a −10 dB gain, or even lower gain contour, from feedhorns 114B would be projected onto the edges of FSS 404. Such reflection of the Ku-band signals 106A-C would leave enough margins for the feedhorns 114B to operate in conjunction with the feedhorns 114A.

The approach disclosed in the present invention of an FSS 404 also improves the available bandwidth of the system. Multiple feedhorns 114B can be employed to utilize all of the Ku-band spectrum currently being used, and feedhorns 114A can now be employed to receive Ka-band spectrum from those same orbital slots, as well as new orbital slots. Geometric constraints of the width of the feedhorn 114A mechanical assembly can now be expanded because the larger, Ku-band feedhorns can be placed elsewhere. The present invention makes available up to 2 GHz of additional spectrum from the 101 WL slot (2×500 MHz for the A and B Ka-bands at the 101 slot, times two for the left and right circular polarizations).

Further, although FSS 404 is typically contemplated as a flat surface, FSS 404 can be a curved surface, or any shaped surface which allows for placement of feedhorns 114B across a larger arc and/or further out of the path of signals 106A and 402. Further, FSS 404 can be used to focus the signals incident on feedhorns 114B if desired.

So, as shown in FIG. 4, signals 106A (from the 101 WL orbital slot) are reflected from reflector 130 and again reflected from FSS 404 to feedhorns 114B, while signals 402 (from the 99, 101, and 103 WL orbital slots) are reflected from reflector 130 directly to feedhorns 114A, passing either through or around FSS 404 en route to feedhorns 114A.

Figure 5:
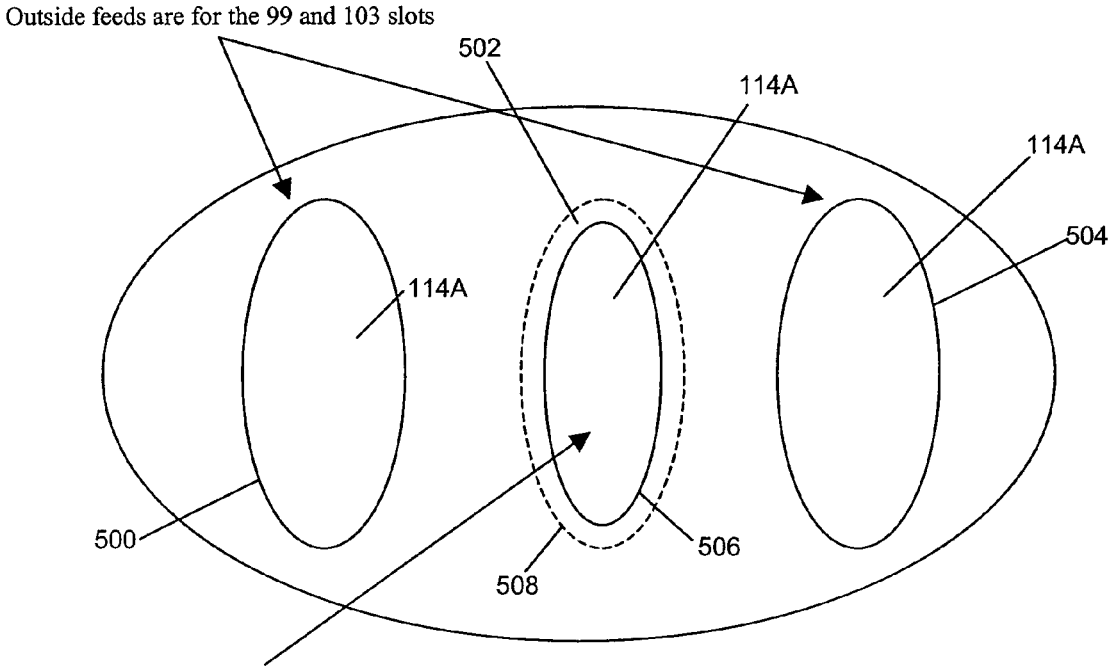
FIG. 5 illustrates a head-on view of the feedhorn locations as viewed from the perspective of the reflector dish in accordance with one or more embodiments of the present invention.

FIG. 5 is a front view illustration of the feedhorn placement for one or more embodiments of the antenna of the present invention.

Feedhorns 114A are shown as viewed from reflector 130, where location 500 receives downlink signals from the 99WL slot, location 502 receives downlink signals from the 101 WL slot, and location 504 receives downlink signals from the 103WL slot. With the present invention, location 502 now has space between location 502 and locations 500 and 504, such that the geometry of FSS ODU can be optimized for Ka-band feedhorn 114A placement. FSS 404 can then be used to optimize Ku-band feedhorn 114B placement at another location.

If the operating frequency of the downlink to be delivered from 101 WL is limited to a lower frequency of 18.2 GHz, then a smaller aperture 506 can be used for feedhorn 114A at location 502. However, if the entire Ka-band spectrum is delivered from 101 WL to location 502, a feedhorn 114A will need an aperture 508 that is slightly larger than aperture 506. Such frequency usage can also optimize feed efficiencies.

Although described with respect to Ka-band and Ku-band signals, any two frequency bands can be utilized without departing from the scope of the present invention.

Flowchart

Figure 6:
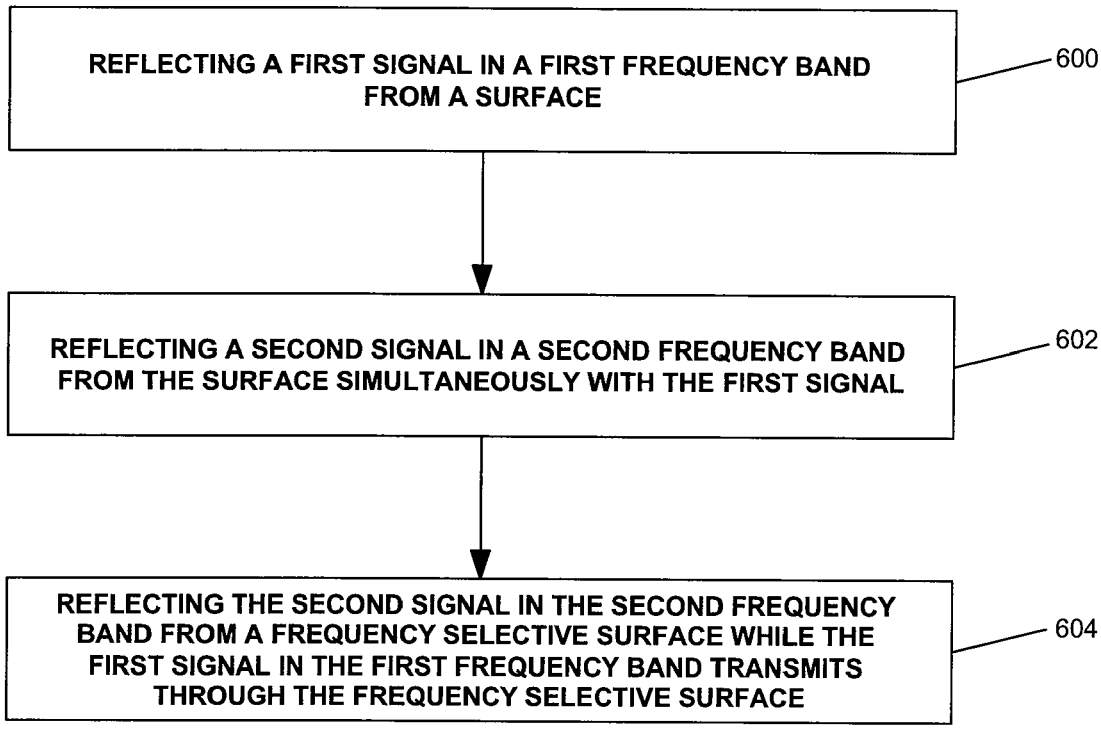
FIG. 6 is a flowchart illustrating the steps used in performing one or more embodiments of the present invention.

FIG. 6 is a flowchart illustrating the steps used in performing one or more embodiments of the present invention.

Box 600 represents reflecting a first signal in a first frequency band from a surface.

Box 602 represents reflecting a second signal in a second frequency band from the surface simultaneously with the first signal.

Box 604 represents reflecting the second signal in the second frequency band from a frequency selective surface while the first signal in the first frequency band transmits through the frequency selective surface.

CONCLUSION

The foregoing description of embodiments of the invention has been presented for the purposes of illustration and description. It is not intended to be exhaustive or to limit the invention to the precise form disclosed. Many modifications and variations are possible in light of the above teaching.

Methods, systems, and apparatuses for receiving signals from communications satellites have been described.

An antenna unit for receiving signals transmitted from a plurality of communications satellites at a plurality of orbital slots, in accordance with one or more embodiments of the present invention comprises a first reflecting surface, a frequency selective reflective surface, and a plurality of low noise block down converters with feedhorns (LNBFs), wherein at least a first LNBF is placed on the antenna unit in a first location and receives at least first signals at a first frequency band from a first orbital slot and at least a second LNBF is placed on the antenna unit at a second location and receives at least second signals at a second frequency band from a second orbital slot, wherein the first signals reflect from the first reflecting surface and transmit through the frequency selective surface and the second signals reflect from the first reflecting surface and also reflect from the frequency selective surface.

Such an antenna unit further may optionally comprise the first frequency band being Ka-band, the second frequency band being Ku-band, and the first signals and the second signals are transmitted from the same orbital slot.

A method in accordance with one or more embodiments of the present invention comprises reflecting a first signal in a first frequency band from a surface, reflecting a second signal in a second frequency band from the surface simultaneously with the first signal, and reflecting the second signal in the second frequency band from a frequency selective surface while the first signal in the first frequency band transmits through the frequency selective surface.

Such a method further may optionally comprise the first frequency band being Ka-band, the second frequency band being Ku-band, and the first signal and the second signal being transmitted from the same orbital slot.

A satellite television signal reception system in accordance with one or more embodiments of the present invention comprises a reflecting dish, a frequency selective surface, a first low noise block down converter with feedhorn (LNBF) receiving first signals that are reflected from the reflecting dish and transmitted through the frequency selective surface, and a second LNBF receiving second signals that are reflected from the reflecting dish and reflected from the frequency selective surface.

Such a system may further optionally comprise the first signals being in a Ka-band and the second signals being in a Ku-band.

It is intended that the scope of the invention be limited not by this detailed description, but rather by the claims appended hereto and the equivalents thereof. The above specification, examples and data provide a complete description of the manufacture and use of the composition of the invention. Since many embodiments of the invention can be made without departing from the spirit and scope of the invention, the invention resides in the claims hereinafter appended and the equivalents thereof.

What is claimed is:

1. An antenna unit for receiving signals transmitted from a plurality of communications satellites at a plurality of orbital slots, comprising:

a first reflecting surface;

a frequency selective reflective surface, and a plurality of low noise block down converters with feedhorns (LNBFs), wherein at least a first LNBF is placed on the antenna unit in a first location and receives at least first signals at a first frequency band from a first orbital slot and at least a second LNBF is placed on the antenna unit at a second location and receives at least second signals at a second frequency band from a second orbital slot, wherein the first signals reflect from the first reflecting surface and transmit through the frequency selective surface and the second signals reflect from the first reflecting surface and also reflect from the frequency selective surface, and wherein gain of the first signals in the first frequency band is optimized over gain of the second signals in the second frequency band.

2. The antenna unit of claim 1, wherein the first frequency band is Ka-band.

3. The antenna unit of claim 1, wherein the second frequency band is Ku-band.

4. The antenna unit of claim 1, wherein the first signals and the second signals are transmitted from the same orbital slot.

5. A method for receiving a signal, comprising:

reflecting a first signal in a first frequency band from a surface;

reflecting a second signal in a second frequency band from the surface simultaneously with the first signal; and reflecting the second signal in the second frequency band from a frequency selective surface while the first signal in the first frequency band transmits through the frequency selective surface, wherein gain of the first signal in the first frequency band is optimized over gain of the second signal in the second frequency band.

6. The method of claim 5, wherein the first frequency band is Ka-band.

7. The method of claim 5, wherein the second frequency band is Ku-band.

8. The antenna unit of claim 5, wherein the first signal and the second signal are transmitted from the same orbital slot.

9. A satellite television signal reception system, comprising:

a reflecting dish;

a frequency selective surface;

a first low noise block down converter with feedhorn (LNBF) receiving first signals that are reflected from the reflecting dish and transmitted through the frequency selective surface; and a second LNBF receiving second signals that are reflected from the reflecting dish and reflected from the frequency selective surface wherein gain of the first signals in the first frequency band is optimized over gain of the second signals in the second frequency band.

10. The satellite television signal reception system of claim 9, wherein the first signals are in a Ka-band and the second signals are in a Ku-band.

* * * * *